US009366470B2

(12) United States Patent
Hastürk et al.

(10) Patent No.: US 9,366,470 B2
(45) Date of Patent: Jun. 14, 2016

(54) CANTILEVERED SHELVING RACK

(75) Inventors: Cemalettin Hastürk, Cerkezkoy/Tekirdag (TR); Andrew Roberson, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 361 days.

(21) Appl. No.: 13/334,225

(22) Filed: Dec. 22, 2011

(65) Prior Publication Data

US 2013/0160483 A1 Jun. 27, 2013

(51) Int. Cl.

| | |
|---|---|
| ***F25D 25/02*** | (2006.01) |
| ***F25D 11/00*** | (2006.01) |
| ***A47B 96/14*** | (2006.01) |
| ***A47F 3/04*** | (2006.01) |

(52) U.S. Cl.

CPC ..... *F25D 11/00* (2013.01); *A47B 96/1458* (2013.01); *A47F 3/0482* (2013.01); *F25D 25/02* (2013.01)

(58) Field of Classification Search

CPC ..... F25D 25/02; F25D 25/021; F25D 25/024; A47B 57/42; A47B 57/52

USPC ..... 62/382, 465; 312/408, 410; 248/244, 248/250; 211/103, 187, 190, 191, 192, 193; 108/108

See application file for complete search history.

(56) References Cited

U.S. PATENT DOCUMENTS

| | | | | |
|---|---|---|---|---|
| 4,299,368 | A * | 11/1981 | Winkler | 248/246 |
| 4,443,979 | A * | 4/1984 | Varon et al. | 52/36.6 |
| 5,040,856 | A * | 8/1991 | Wilkins et al. | 312/402 |
| 6,065,821 | A * | 5/2000 | Anderson et al. | 312/408 |
| 6,682,253 | B2 * | 1/2004 | Binna et al. | 403/263 |
| 7,784,626 | B2 * | 8/2010 | Jacques et al. | 211/103 |
| 2006/0163985 | A1 * | 7/2006 | Blersch et al. | 312/408 |
| 2008/0219795 | A1 * | 9/2008 | Anderson et al. | 410/105 |
| 2009/0145493 | A1 * | 6/2009 | Lee | 137/360 |
| 2009/0302726 | A1 * | 12/2009 | Eckartsberg | 312/312 |
| 2010/0164342 | A1 * | 7/2010 | Hagele et al. | 312/408 |
| 2010/0258692 | A1 * | 10/2010 | Kluge | 248/250 |

* cited by examiner

*Primary Examiner* — Cassey D Bauer
*Assistant Examiner* — Antonio R Febles
(74) *Attorney, Agent, or Firm* — James E. Howard; Andre Pallapies

(57) ABSTRACT

A refrigerator comprises a main body having an enclosable interior compartment, the compartment including at least one wall having and at least one channel recessed into the wall; at least one shelf mounted in the compartment; and a fixing rail mounted to the wall and within the channel so that the fixing rail and portions of the wall adjacent the channel are substantially flush. The fixing rail has a plurality of mounting locations for the shelf to allow adjustable mounting of the shelf relative to the wall.

24 Claims, 5 Drawing Sheets

CANTILEVERED SHELVING RACK

BACKGROUND

FIG. 1 shows a prior art shelving rack 100 for cantilevered mounting of a shelf (not shown). The shelving rack includes an extrusion 102 and an insert 104 (with mounting apertures 105) that is slidably received in a slot 106 formed in the extrusion 102. The rack 100 is mounted to a back wall of the refrigerator, in a traditional manner, in which at least the upper part of the rack protrudes a height H relative to the wall W.

SUMMARY

One aspect of the present technology is to address one or more shortcomings of the prior art, e.g., by providing a more compact and/or fluid refrigerator/rail design, and/or which allows more freedom to design adjacent components that do not require modifications of the rail/refrigerator/components or additional labor relating to the rack.

Another aspect of the present technology is directed to a refrigerator comprising a main body having an enclosable interior compartment, the compartment including at least one wall having and at least one channel recessed into the wall; at least one shelf mounted in the compartment; and a fixing rail mounted to the wall and within the channel so that the fixing rail and portions of the wall adjacent the channel are substantially flush, the fixing rail having a plurality of mounting locations for the shelf to allow adjustable mounting of the shelf relative to the wall, e.g. via conventional brackets to support the shelf or shelves.

Another aspect of the present technology is directed to a fixing rail, including a base part (e.g., and extrusion) and an insert slidable within the base part. The base part includes structure to support the insert and is generally adapted to blend with the refrigerator wall to which it is attached.

These and other aspects of the present technology will be described in or apparent from the following detailed description.

DETAILED DESCRIPTION

The present technology is described in relation to several examples that may share one or more common features. It should be noted that an aspect of one example can be combined with an aspect of another example, and that any aspect of any example may form the basis for subject matter applicant may wish to pursue.

Figure 2:
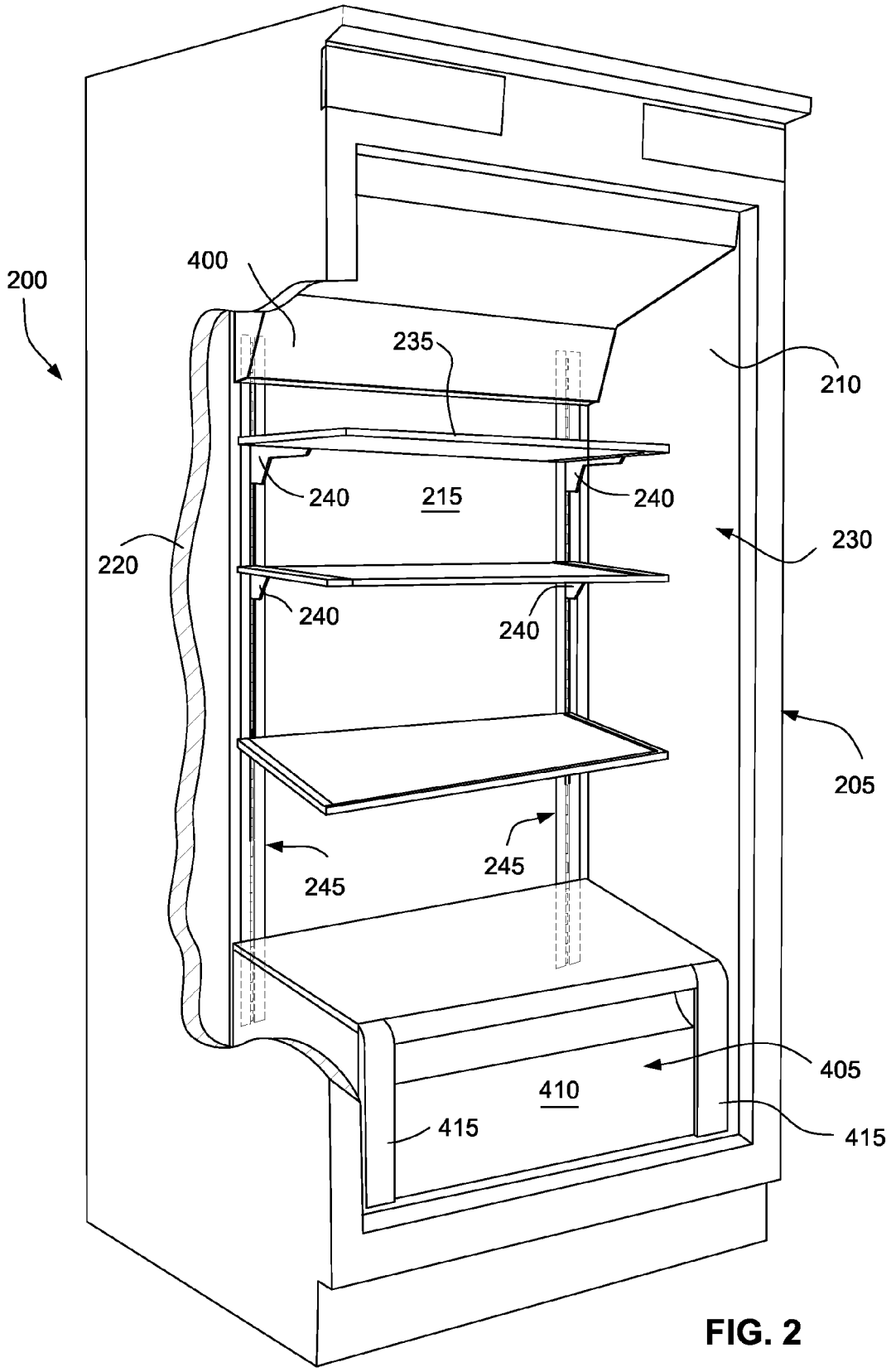
FIG. 2 is a partially broken away perspective view of a refrigerator according to an example of the present technology.

FIG. 2 is a perspective view of a refrigerator 200 having a main body 205 including a plurality of walls 210, 215, 220 forming an enclosable interior compartment 230 that may be accessed via a door (not shown). The refrigerator is for keeping food and beverage items, etc., at cool temperatures. A typical refrigerator normally includes a compressor to circulate a refrigerant though a refrigeration circuit, e.g., including a first set of heat-exchanging pipes (serpentine or coiled set of pipes outside the unit), an expansion valve, and a second set of heat-exchanging pipes (serpentine or coiled set of pipes inside the unit).

The compartment 230 includes at least one shelf 235 that is adjustably supported on one of the walls 210, 215, 220. Each shelf 235 has a support surface for food and beverage items, etc., and one or more traditional brackets 240 that include one or more hook portions to engage with one or more fixing rails 245 (two shown in this example mounted on the back wall 215). Each fixing rail 245 provides a plurality of mounting locations for the shelves 235 to allow adjustable mounting of the shelf relative to the wall 215.

Figure 3:
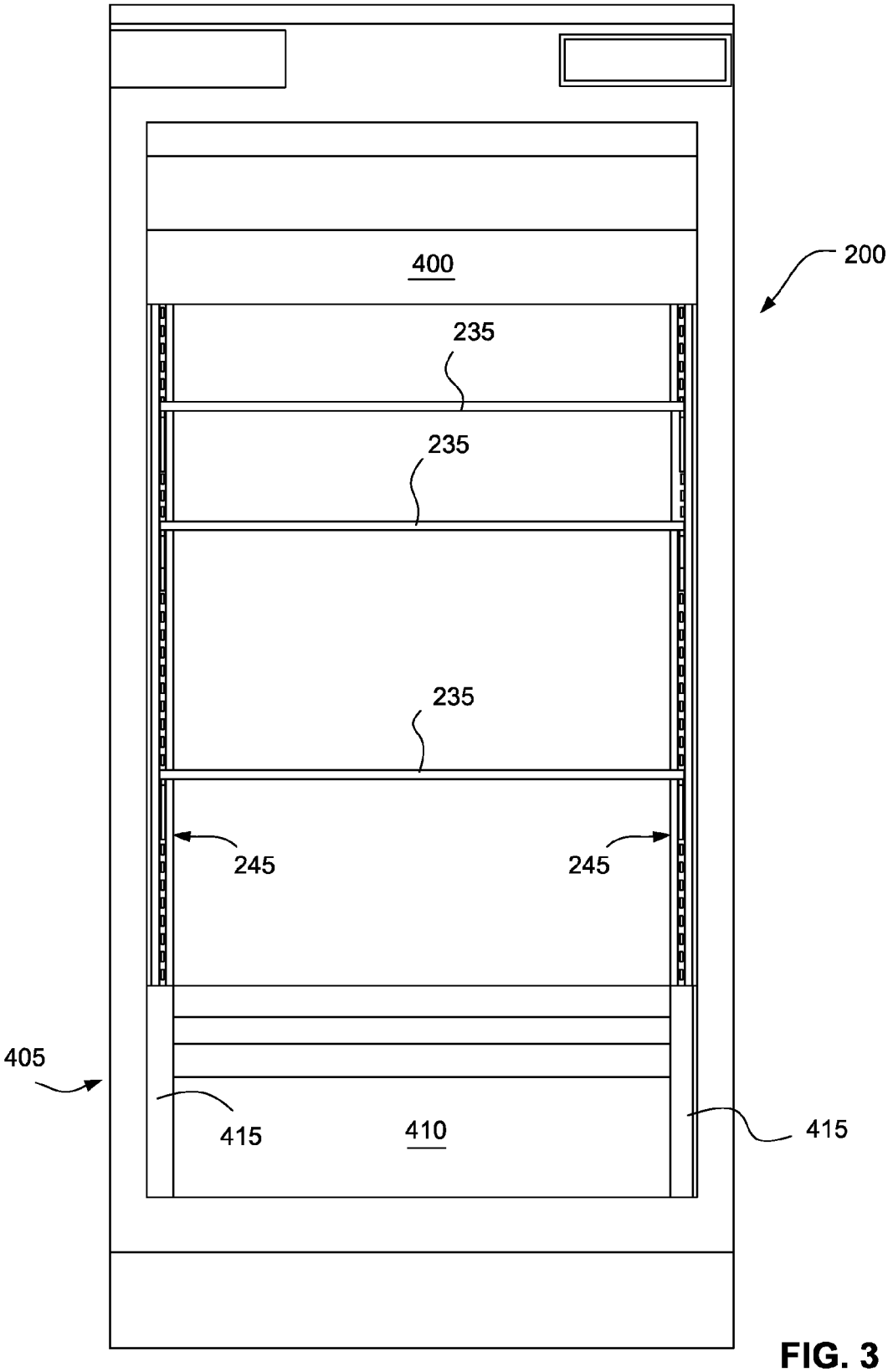
FIG. 3 is a front view thereof.
Figure 4:
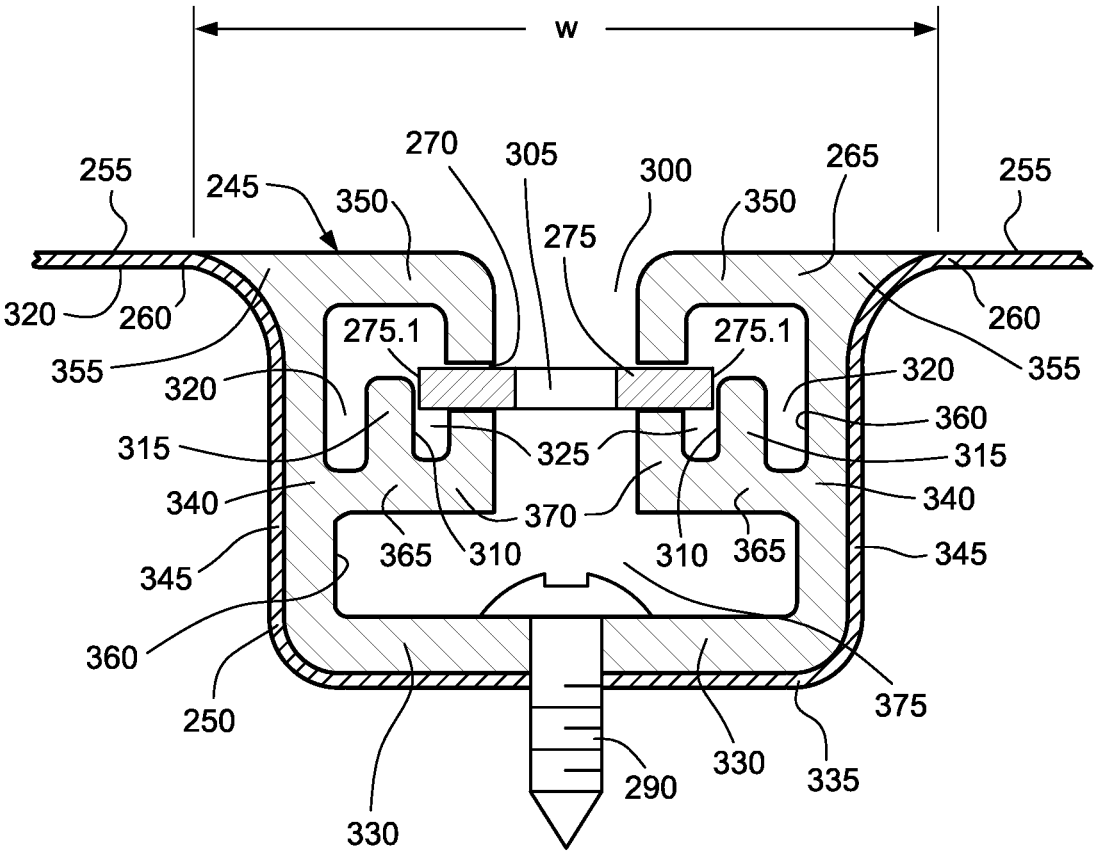
FIG. 4 is a cross sectional view of a fixing rail according to an example of the present technology.

At least one of the walls, e.g., the rear wall 215 shown in FIGS. 2 and 3, includes one or more channels 250 (FIG. 4) in which the fixing rails 245 are mounted. Each channel 250 is recessed into the wall 255. The fixing rail 245 is mounted to the wall 215 and within the channel 250 so that the fixing rail 245 and portions 260 of the wall adjacent the channel 250 are substantially flush, e.g., the fixing rail 245, e.g., its top portion, can be positioned flush with, slightly below or slightly/insignificantly above the plane defined by the portions 260 of the wall adjacent the channel 250.

Figure 5:
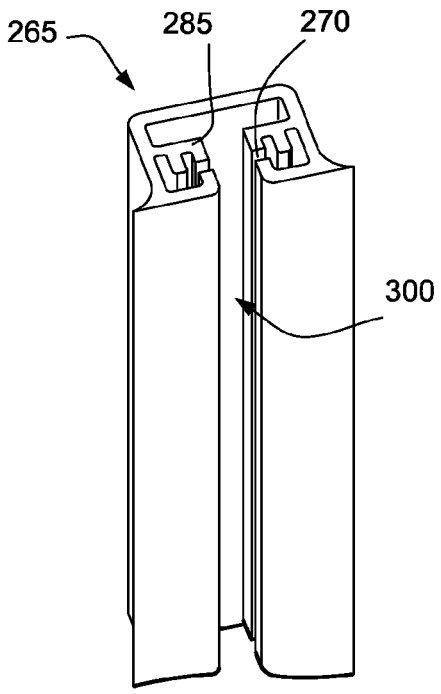
FIG. 5 is a perspective view thereof without the insert.
Figure 6:
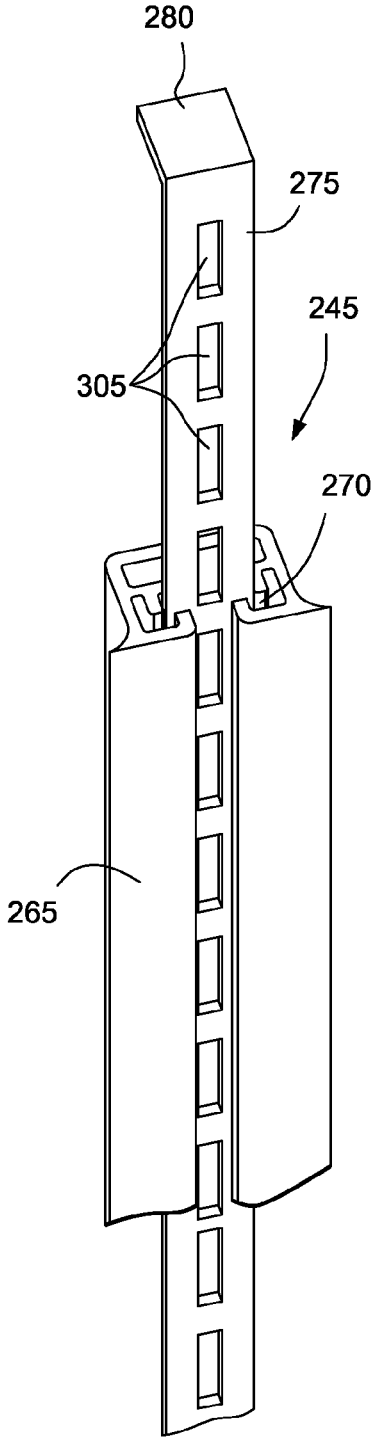
FIG. 6 is a perspective view thereof as the insert is being inserted into the base part of the fixing rail.
Figure 7:
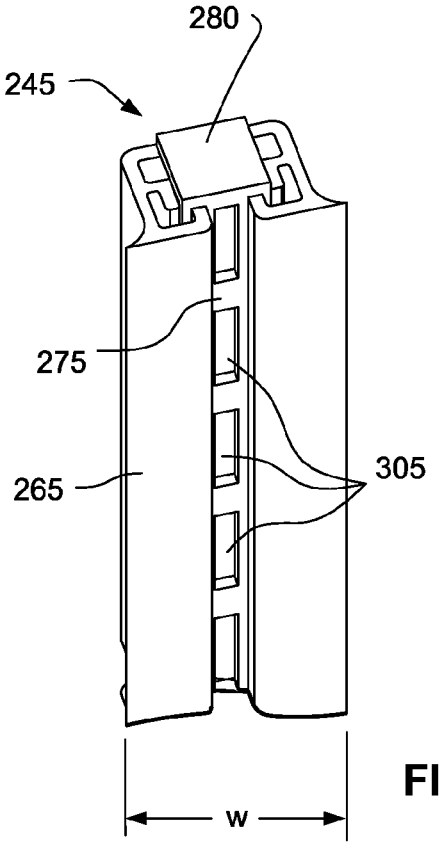
FIG. 7 is a perspective view thereof showing the insert in the fully inserted position relative to the base part.

The fixing rail 245 (FIG. 5) includes a base part 265 to be fixedly secured in the channel 250, the base part including a slot 270, and an insert 275 that is adapted to be slidably received in the slot 270. The insert 275 has a stop 280 formed at one end thereof that is adapted to rest on an upper shoulder 285 of the base part 265. The insert, due to the stop, may have an L shape.

The base part 265 may comprise an extrusion. A fastener 290 (FIG. 4), e.g., a screw or bolt, may be provided to secure the base part 265 to the wall 215, wherein the base part 265 includes an access opening 300, in communication with the slot 270, to allow passage of a tool (not shown) for engagement with the fastener 290. The insert 275 may include a plurality of apertures 305 to allow height-adjustable mounting of the shelf 235, at least one of the apertures 305 being sized to allow passage of the tool to access the fastener. The insert 275 is inserted into the slot 270 before the base part 265 and insert 275 are inserted into the channel 250.

The slot 270 may include lateral sides 310 to engage or guide lateral edges 275.1 of the insert. Each lateral side 310 may comprise a protrusion 315 extending generally perpendicular to the wall 255. Each protrusion 315 may include an adjacent open space 320, 325 laterally and/or outside the protrusion.

The base part 265, in cross section or along an end view (FIG. 4), has a bottom portion 330 to face a bottom 335 of the channel, side portions 340 to face sides 345 of the channel, and a top portion 350 that is substantially flush with the adjacent portions 260 of the wall 255. A transition 355 between the top portion 350 and each side portion 340 includes a curved radius that terminates in a sharp tip. The upper part of the sharp tip is substantially flush with the wall of the refrigerator. The side portions 340 are generally linear and uninterrupted from the bottom portion 330 to the transition 355/top portion 350.

The base part 265 may have a generally U shape (FIG. 4), with each interior side 360 of the U-shape having an inwardly oriented projection 365, each inwardly oriented projection 365 having an end projection 370 to support a face of the insert and the protrusion 315 (otherwise called an intermediate projection) to guide the lateral edge 275.1 of the insert 275.

The base part 265 may include a generally rectangular opening 375 positioned along the bottom portion 330 of the U shape. The access opening 300 may be in communication with the rectangular opening 375 and the slot 270.

Figure 1:
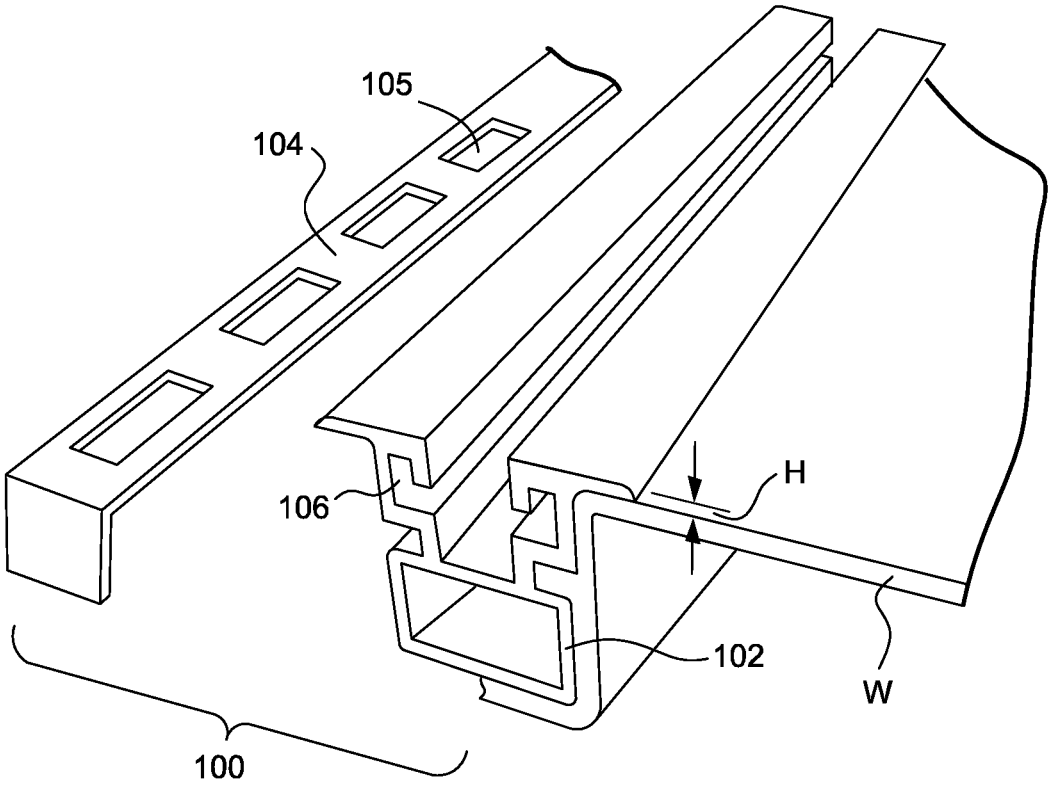
FIG. 1 (PRIOR ART)
FIG. 1 is a perspective view of a rack according to the prior art.

The refrigerator 200 may further comprise at least one adjacent fixture or component, e.g., a cover 400 or a drawer 405, positioned above and/or below the fixing rail 245 (FIGS. 1 and 2). The fixing rail, because it is flush or below the wall surface, may extend behind the fixture or component 400, 405, without the need to cut the fixing rail. This also provides a clean looking design that avoids a hard looking cut off of the track, allowing the fixing rail to simply "disappear" behind the component(s).

The drawer 405 also may have a center section 410 (e.g., transparent) and at least one end cap 415, wherein the end cap 415 is aligned with the fixing rail 245. The end cap 415 and the fixing rail have substantially the same width w.

While the present technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the disclosure.

What claimed is:

1. A refrigerator comprising:

a main body having an enclosable interior compartment, the compartment including at least one wall having and at least one channel recessed into the wall;

at least one shelf mounted in the compartment; and a fixing rail including a base part to be fixedly secured in the channel, the base part including a slot, and an insert that is adapted to be slidably received in the slot, wherein the base part, in cross section or along an end view, has a bottom portion that faces a bottom of the channel, side portions that face sides of the channel, and a top portion that is positioned flush with or slightly below a plane defined by adjacent portions of the wall, wherein the base part further comprises a transition between the top portion and each side portion, the transition including a curved radius that converges with the top portion to form an outwardly extending pointed tip that is positioned flush with or slightly below the plane defined by adjacent portions of the wall, wherein the fixing rail is mounted to the wall and within the channel so that the fixing rail is positioned substantially flush with the plane defined by portions of the wall adjacent to the channel, wherein a side of each channel and the corresponding wall of the compartment form a curved corner such that the curved radius of the transition is flush with the curved corner, and wherein the fixing rail has a plurality of mounting locations for the shelf to allow adjustable mounting of the shelf relative to the wall.

2. The refrigerator according to claim 1, further comprising a compressor to circulate a refrigerant through a plurality of coils mounted on the main body.

3. The refrigerator according to claim 1, wherein the insert has a stop formed at one end thereof that is adapted to rest on an upper shoulder of the base part.

4. The refrigerator according to claim 1, wherein the insert has an L shape.

5. The refrigerator according to claim 1, wherein the base part comprises an extrusion.

6. The refrigerator according to claim 1, further comprising a fastener to secure the base part to the wall, wherein the base part includes an access opening, in communication with the slot, to allow passage of a tool for engagement with the fastener, the insert including a plurality of apertures to allow height-adjustable mounting of the shelf, at least one of the apertures being sized to allow passage of the tool to access the fastener.

7. The refrigerator according to claim 1, wherein the slot includes lateral sides to engage lateral edges of the insert.

8. The refrigerator according to claim 7, wherein each lateral side comprises a protrusion extending generally perpendicular to the wall.

9. The refrigerator according to claim 8, wherein each said protrusion includes an adjacent open space laterally outside the protrusion.

10. The refrigerator according to claim 1, wherein the base part has a generally U-shape, with each interior side of the U-shape having an inwardly oriented projection, each inwardly oriented projection having an end projection to support a face of the insert and an intermediate projection to guide a lateral edge of the insert.

11. The refrigerator according to claim 10, further comprising a space between the end and intermediate projections, and a space between the intermediate projection and the interior side.

12. The refrigerator according to claim 10, wherein the base part further includes a generally rectangular opening positioned along the bottom portion of the U-shape.

13. The refrigerator according to claim 12, further comprising an access opening in communication with the rectangular opening and the slot.

14. The refrigerator according to claim 10, wherein the side portions are generally linear and uninterrupted from the bottom portion to the top portion.

15. The refrigerator according to claim 1, wherein the main body further comprises at least one fixture or component positioned above and/or below the fixing rail, the fixing rail extending behind the fixture or component.

16. The refrigerator according to claim 1, further comprising a drawer with a center section and at least one end cap, wherein the end cap is aligned with the fixing rail.

17. The refrigerator according to claim 16, wherein the end cap and the fixing rail have substantially the same width.

18. A fixing rail comprising:

a base part including:

two side portions facing one another, a top portion extending from each side portion, a bottom portion extending from each side portion, an interior surface of the bottom portion facing an interior surface of each top portion such that each side portion is positioned between corresponding ones of the top portion and the bottom portion, an inwardly oriented projection attached to and extending from an interior side of each said side portion between each said top portion and said bottom portion, a protrusion extending toward said top portion from each said inwardly oriented projection and each protrusion being inwardly spaced from and parallel to each said side portion, said protrusion having an upper end spaced from the top portion, and a slot defined, at least in part, by a lateral side surface of each of the protrusions that is parallel to each of the side portions; and an insert shaped and dimensioned to be slidably received in the slot between each of the protrusions such that each of the protrusions are separated by the insert, the insert having lateral edges that are parallel, and each lateral edge engages the lateral side surface of a corresponding protrusion that faces the slot, wherein each said inwardly oriented projection further includes an end projection to support a lower face of the insert.

19. The fixing rail according to claim 18, wherein each said end projection is spaced from its relative protrusion.

20. The fixing rail according to claim 18, wherein a height of the protrusion is greater than a height of the end projection.

21. A fixing rail in combination with a refrigerator for mounting a shelf within a recess on a wall of said refrigerator, the fixing rail comprising:

a base part having a slot; and an insert slidably received within the slot, wherein the base part comprises a top portion dimensioned and configured to be positioned flush with or slightly below a plane defined by adjacent portions of the wall, wherein the base part, in cross section, has a bottom portion, and side portions extending from the bottom portion and connected to the top portion, wherein the base part further comprises a transition between the top portion and each side portion, the transition including a curved radius that converges with the top portion to form an outwardly extending pointed tip that is positioned flush with or slightly below the plane defined by adjacent portions of the wall, and wherein the curved radius of the transition is shaped and dimensioned to be flush with a curved corner formed between a side of the recess and the wall of the refrigerator.

22. The fixing rail according to claim 21, wherein the base part has a generally U-shape.

23. The fixing rail according to claim 22, wherein side portions of the generally U-shape are generally linear and uninterrupted from a bottom portion of the U-shape to the top portion.

24. The fixing rail according to claim 22, wherein the top portion defines a planar surface extending to each respective outer edge of said top portion.

* * * * *